US005477646A

United States Patent [19]

Dietz et al.

[11] Patent Number: 5,477,646

[45] Date of Patent: Dec. 26, 1995

[54] SHUTTER ASSEMBLY FOR PROTECTING WINDOWS AND THE LIKE

[76] Inventors: Grant F. Dietz, 15350 Bowsprit Ct., Corpus Christie, Tex. 78418; Per H. Angermo, Kr. Quales gt. 1-3, 8650 Mosjoen, Norway

[21] Appl. No.: 180,273

[22] Filed: Jan. 12, 1994

[51] Int. Cl.[6] ..... E06B 9/02

[52] U.S. Cl. ..... 52/202; 52/780; 49/61

[58] Field of Search ..... 52/202, 204.72, 52/458, 476, 473, 506.06, 506.1, 508, 780, 781; 49/61; 160/172 R, 201

[56] References Cited

U.S. PATENT DOCUMENTS

| | | | |
|---|---|---|---|
| 910,010 | 1/1909 | Mockridge . | |
| 2,047,086 | 7/1936 | Stephens | 52/202 |
| 2,587,440 | 2/1952 | Burkhart . | |
| 2,835,935 | 5/1958 | Housley | 52/202 X |
| 3,307,316 | 3/1967 | Gray . | |
| 3,745,704 | 7/1973 | Covington . | |
| 4,016,986 | 4/1977 | Thomas . | |
| 4,333,271 | 6/1982 | DePaolo et al. | 52/202 X |
| 4,341,254 | 7/1982 | Schaller et al. | 160/172 R |
| 4,454,691 | 6/1984 | Mitchell | 52/202 |
| 4,553,580 | 11/1985 | Christoffersson | 160/172 R |
| 4,604,827 | 8/1986 | Hitchins . | |
| 4,685,261 | 8/1987 | Seaquist | 52/202 |
| 4,731,952 | 3/1988 | Mascotte . | |
| 5,152,116 | 10/1992 | MacGowan | 52/202 X |
| 5,345,716 | 9/1994 | Caplan | 49/61 |

*Primary Examiner*—Carl D. Friedman
*Assistant Examiner*—Kevin D. Wilkens
*Attorney, Agent, or Firm*—Bacon & Thomas

[57] ABSTRACT

A protective shutter assembly includes a pair of rail members that are adapted to be mounted on opposing vertical sides of a window or the like, along with a plurality of shutter panels adapted to extend between the rail members. Each rail member includes an elongated channel which opens toward an associated channel of the other rail member. The shutter panels and the rail members are preferably formed from an extrusion process to reduce manufacturing costs. Due to this construction, the channels have open ends. The lower end of each channel is closed off, at least partially, such that the interengaging shutter panels can be positioned between the associated rail members and retained within the channels. According to one embodiment, the lower end of each channel is closed off by a substantially L-shaped bracket which is also preferably formed from an extrusion process and includes a first portion that projects into a longitudinally extending slot formed integral with the channel and a second portion that extends across the open end. According to the invention, the rail members can be individually formed and secured on either side of a window or the like, or integrally formed with a window frame.

15 Claims, 4 Drawing Sheets

SHUTTER ASSEMBLY FOR PROTECTING WINDOWS AND THE LIKE

BACKGROUND OF THE INVENTION

1. Field of the Invention

The present invention pertains to a shutter assembly for protecting windows and the like of a building during severe weather storms.

2. Discussion of the Prior Art

Upon learning of an impending severe weather storm, it is common to provide for additional protection from broken glass and the like by taping, boarding or otherwise covering glass windows and doors of a residence or other building. Installing such known protection arrangements is generally time consuming. In some situations, such as commonly found in tropical areas, the advance warning time of such storms does not allow for full installation of such protection arrangements. Often, removing these protection arrangements require even greater lengths of time.

It has also been known heretobefore to hingely attach shutters on either side of a window or the like wherein the shutters could be pivoted to a position covering the window during severe storms. Once positioned across the window, the shutters are latched together. These types of protection arrangements, although superior to the other known arrangements discussed above especially with respect to a reduction in set-up time, have numerous shortcomings. For example, the shutters and the mounting hardware therefore require a fair amount of maintenance to assure adequate performance. In addition, the latches and additional hardware are prone to damage from various causes, including severe wind gusts, which results in a short working life and failure of the shutter arrangement, often when they are most needed. For these and other reasons, shutters are now often used on residential buildings for cosmetic purposes only.

Additional window guard assemblies have been introduced in attempts to overcome the problems associated with the prior art. Such assemblies are disclosed, for example, in U.S. Pat. Nos. 3,745,704 and 4,604,827. In each of these patented systems, auxiliary frame members are mounted about portions of a window and are adapted to selectively receive shutter panels. Unfortunately, mainly due to their construction, these known systems suffer from some of the drawbacks discussed above, are expensive to manufacture and are not aesthetically appealing.

Therefore, there exists a need in the art for a shutter assembly for use in protecting windows or the like during severe weather conditions that is economical to produce, aesthetically appealing, designed to have a long useful life and which requires little to no maintenance.

SUMMARY OF THE INVENTION

It is an object of the present invention to provide a shutter system which can be readily assembled in order to protect windows and the like of a building during severe weather conditions.

It is another object of the present invention to provide a shutter assembly that is not only economical to manufacture, but is aesthetically appealing, substantially maintenance free and has a long associated useful life.

It is still a further object of the present invention to provide a shutter assembly that can be readily made to conform for use with variously sized and shaped windows or the like, which can be easily installed and which is generally compact in size.

These and other objects of the invention are achieved by providing a shutter assembly that includes a pair of rail members that are adapted to be mounted on opposing vertical sides of a window or the like, along with a plurality of interengaging shutter panels adapted to extend between the rail members. Each rail member includes an elongated channel which opens toward an associated channel of the other rail member. The rail members are preferably formed from an extrusion process to reduce manufacturing costs. Due to this construction, the channels have open ends. The lower end of each channel is closed off, at least partially, such that the interengaging shutter panels can be positioned between the associated rail members and retained within the channels. According to one embodiment, the lower end of each channel is closed off by a substantially L-shaped bracket which includes a first portion that projects into a longitudinally extending slot formed integral with the channel and a second portion that extends across the open end. According to the invention, the rail members can be individually formed and secured on either side of a window or the like, or integrally formed with a window frame.

Additional objects, features and advantages of the present invention will become more readily apparent from the following description of preferred embodiments of the invention taken in conjunction with the drawings wherein like reference numerals refer to corresponding parts in the several views.

DETAILED DESCRIPTION OF THE PREFERRED EMBODIMENTS

Figure 1:
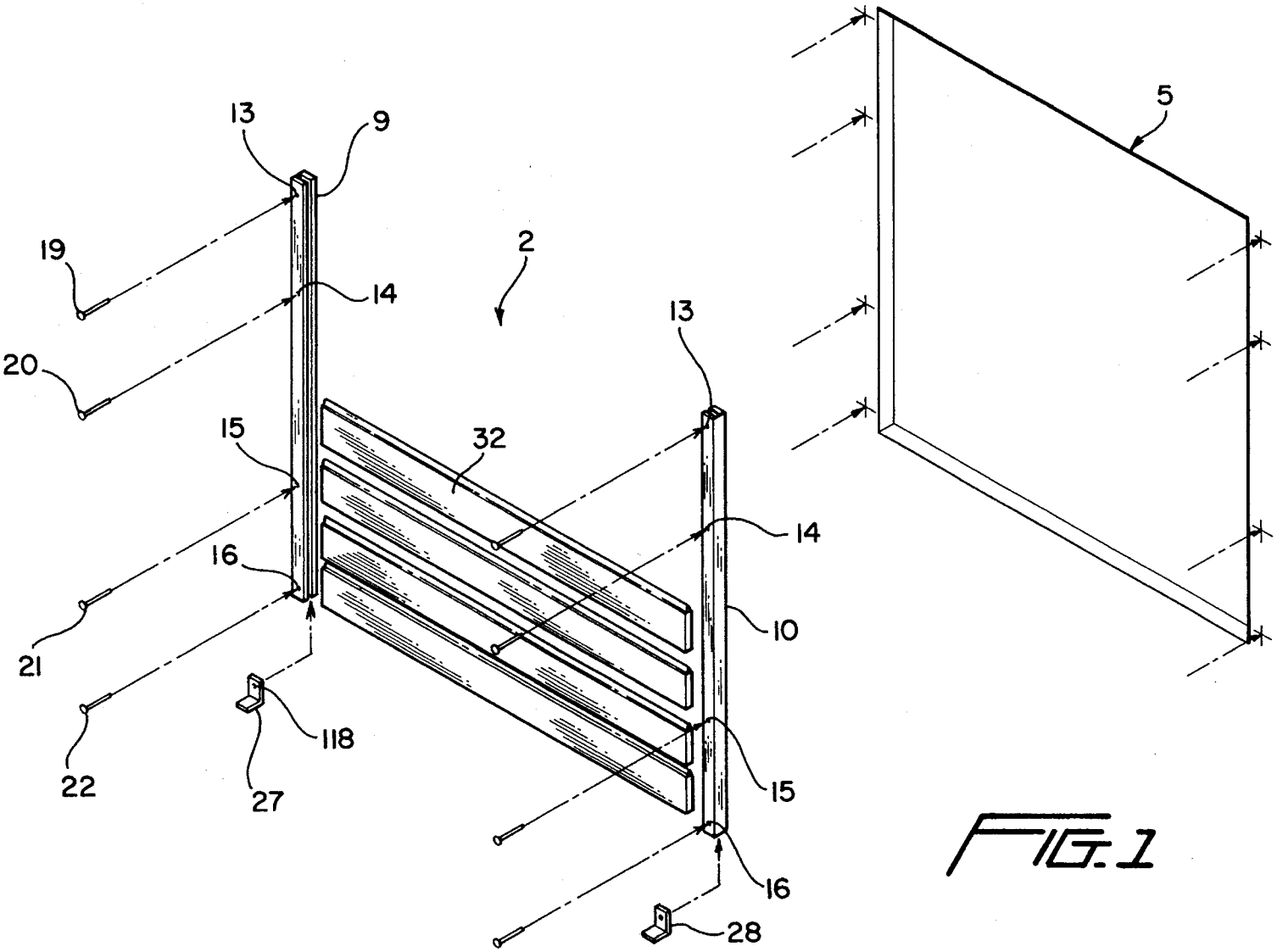
FIG. 1 is an exploded view of a shutter assembly according to a first embodiment of the invention.

With initial reference to FIG. 1, the shutter assembly of the present invention is generally indicated at 2. Shutter assembly 2 is adapted to be mounted about a window opening 5 or the like of a building in order to prevent the breaking of glass during severe weather storms, such as hurricanes. In general, shutter assembly 2 includes a pair of rail members 9 and 10 which are adapted to be mounted adjacent opposing longitudinal sides of window opening 5. For mounting purposes, each rail member 9, 10 of shutter assembly 2 is provided with a plurality of longitudinally spaced apertures 13–16. The specific number and spacing of apertures 13–16 can be widely varied without departing from the spirit of the invention. Apertures 13–16 are adapted to receive respective fasteners 19–22, such as screws, bolts or the like, for securing rail members 9 and 10 along window opening 5. According to the preferred embodiment shown, shutter assembly 2 further includes a pair of L-shaped brackets 27 and 28, along with a plurality of shutter panels or slats 32, as will be more fully discussed below.

Figure 2:
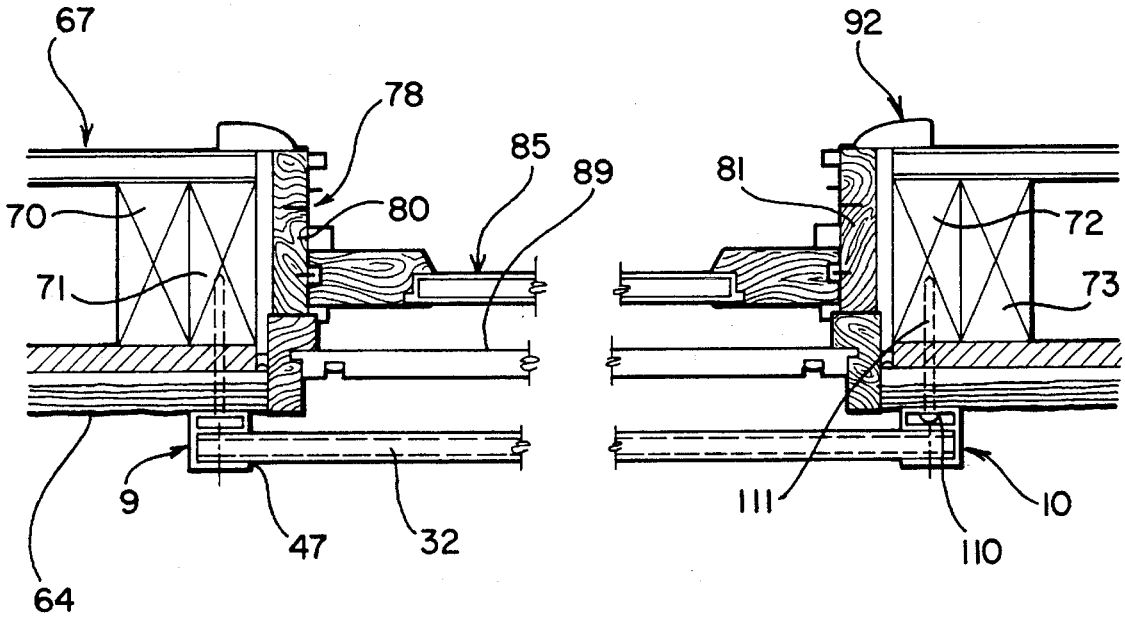
FIG. 2 is a cross-sectional top view of a portion of a building with the shutter assembly of FIG. 1 mounted on opposing sides of a window therein.
Figure 3:
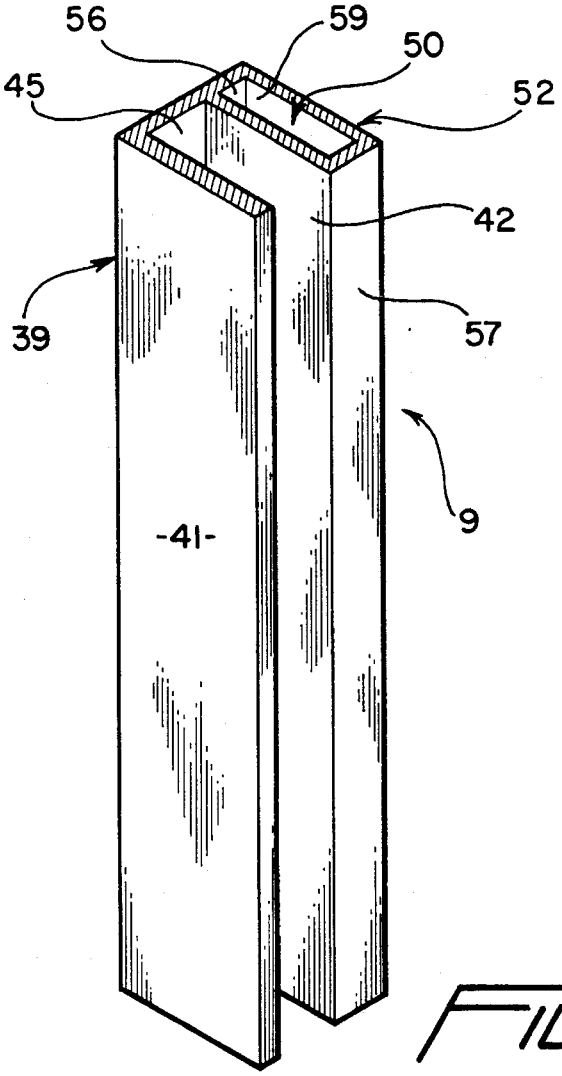
FIG. 3 is an enlarged perspective view of a portion of the shutter assembly depicted in FIG. 1.
Figure 4:
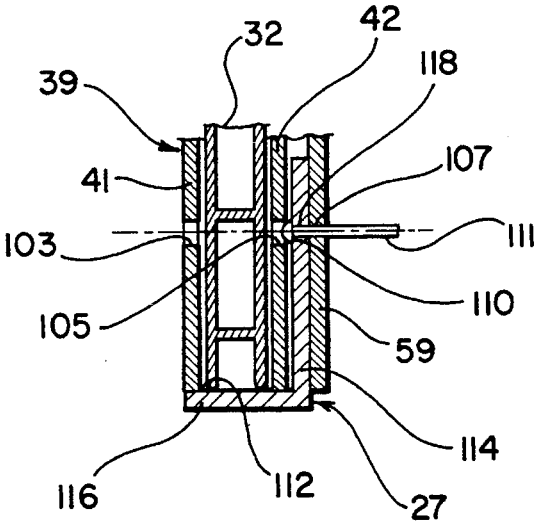
FIG. 4 is a cross-sectional side view of a lower portion of the shutter assembly of FIG. 1 in an assembled state.

Reference will now be made to FIGS. 2–4 in describing additional structural features of shutter assembly 2 and a preferred mounting arrangement therefor. Each rail member 9, 10 comprises a longitudinally extending channel 39 that is defined by first and second opposing walls 41, 42 that are interconnected by a bridging wall 45. Channel 39 is therefore generally U-shaped in cross-section and defines a longitudinally extending opening 47 opposite bridging wall 45. Formed adjacent channel 39 is a longitudinally extending slot 50. Slot 50 is located within an enclosure 52 that is defined by opposing, substantially parallel wall pairs. More specifically, enclosure 52 is defined by a first short wall 56 that is an extension of bridging wall 45, a second short wall 57 positioned spatially from short wall 56 and extending substantially parallel thereto, a third wall 59 and second wall 42 of channel 39. As clearly shown in FIG. 3, third wall 59 of enclosure 52 and second wall 42 are also spaced and extend longitudinally in a substantially parallel manner.

Rail members 9 and 10 are adapted to be secured against an exterior surface 64 of a building wall 67. Building wall 67 as depicted in FIG. 2 includes a plurality of stud pairs 70, 71 and 72, 73 between which is situated a window frame generally indicated at 78. Window frame 78 is constructed in a manner known in the art and, as shown, includes a pair of laterally spaced framed sides 80 and 81 between which a pair of movable window sections are positioned, one movable section being indicated at 85. Window frame 78 may further be provided with a screen member 89 and be finished off at an interior portion of building wall 67 with molding such as indicated at 92.

Figure 7:
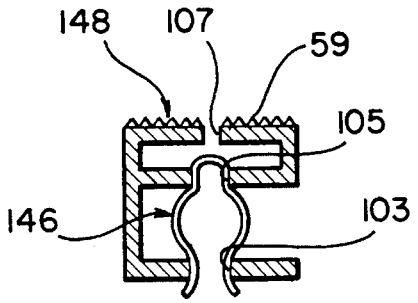
FIG. 7 is a cross-sectional top view of a rail member incorporated in the shutter assembly of the invention, along with an auxiliary retaining clip.

As previously stated, each rail member 9, 10 is provided with a plurality of longitudinally spaced apertures 13–16. Each aperture is defined by, as best shown in FIGS. 4 and 7, a first hole 103 that extends through first wall 41 of channel 39, a second hole 105 that extends through second wall 42 of channel 39 and a third hole 107 that extends through third wall 59 of enclosure 52. Holes 103, 105 and 107 are aligned and hole 107 is formed with a smaller diameter than holes 103 and 105. More specifically, holes 103 and 105 have associated diameters that are slightly larger than head portions 110 of fasteners 19–22. Hole 107, on the other hand, has an associated diameter that is larger than the shaft or connecting portions 111 of fasteners 19–22 but smaller than the head portions 110 thereof. By this arrangement, fasteners 19–22 can extend freely through holes 103 and 105 while only the shaft portions thereof can extend through hole 107 such that the head portions 110 of fasteners 19–22 will come to bear against third wall 59 of enclosure 52 when threaded or otherwise securely fastened to building wall 67 as clearly shown in FIG. 2.

Rail members 9 and 10 are preferably formed from an extrusion process, utilizing metal or polymer materials, thereby minimizing manufacturing costs. For maximum corrosion protection and strength, all of the hardware is preferably formed of stainless steel. Due to this construction method, rails members 9 and 10 are formed with open ends. The lower-most end of rail member 9 is best depicted at 112 in FIG. 4. In order to enable shutter panels 32 to remain positioned within channels 39 when desired, L-shaped brackets 27 and 28 are adapted to extend across and close off the lower open ends of channels 39. This arrangement can best be seen in FIG. 4 wherein L-shaped bracket 27 includes a first portion 114 and a second portion 116. First portion 114 and second portion 116 are preferably extruded as a single plate and are generally oriented perpendicular to one another. First portion 114 is formed with a through hole 118 (also shown in FIG. 1) that substantially corresponds in diameter to hole 107. Through hole 118 is adapted to align with through holes 103, 105 and 107 when first portion 114 is inserted within slot 50. In this position, fastener 19 can be used to secure L-shaped bracket 27 within slot 50 with second portion 116 extending across and closing off the open lower end of channel 39. In a similar manner, L-shaped bracket 28 would function to close off the lower-most channel end of rail member 10.

Figure 5:
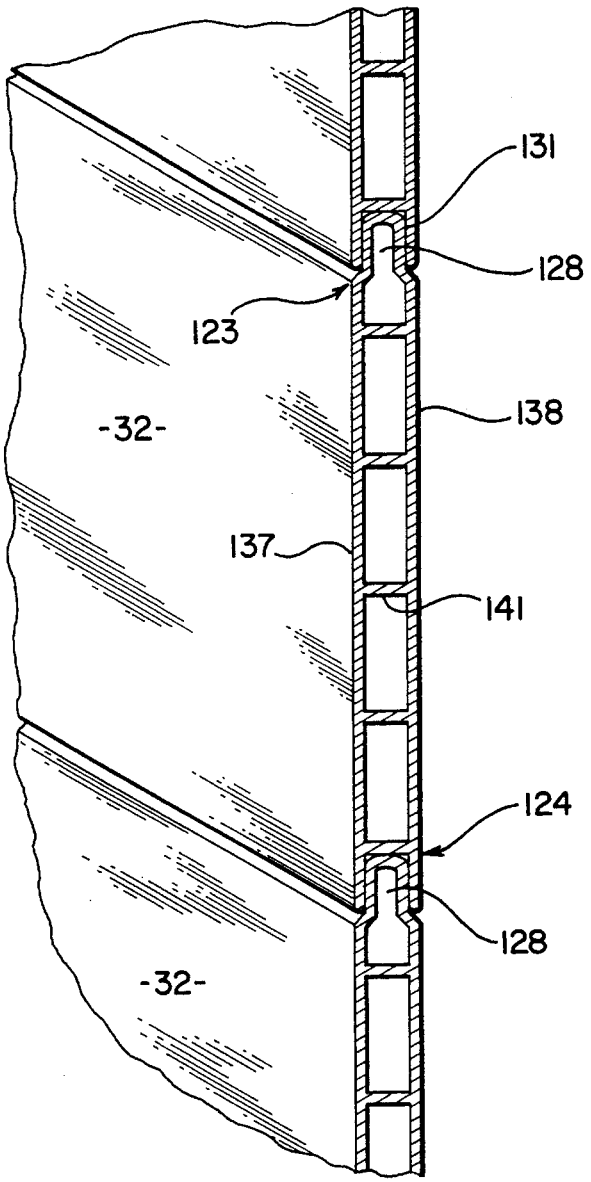
FIG. 5 is a partial perspective view of a plurality of shutter panels incorporated in the shutter assembly of the invention.

FIG. 5 depicts a preferred embodiment of shutter panels 32. Each shutter panel 32 includes upper and lower transversely extending edge sections 123 and 124. Edge section 123 is formed with a tongue portion 128 while edge section 124 is formed with a groove 131. As clearly shown in this Figure, tongue portion 128 is adapted to be snugly received within groove 131 of an adjacent shutter panel 32. In this fashion, when shutter panels 32 are vertically superimposed, they will be interconnected to form a structurally integrated unit by means of the interconnections between tongue portions 128 and grooves 131. Each shutter panel 32 is preferably honeycomb structured so as to define spaced outer walls 137 and 138 that are interconnected by cross-pieces 141. By constructing the shutter panels 32 in this fashion, the weight of the panels can be minimized while maintaining a high structural integrity.

Figure 6:
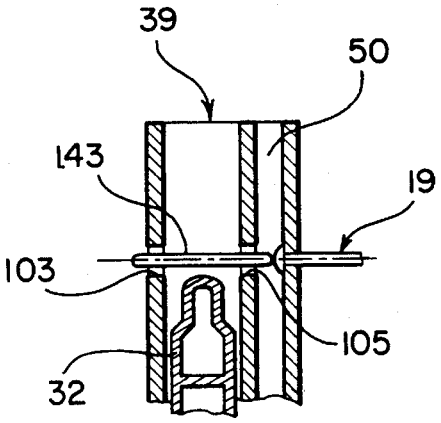
FIG. 6 is a cross-sectional side view of a portion of the shutter assembly of FIG. 1 depicting a mounting aspect of the invention.

FIG. 6 is merely referenced to indicate that the fasteners 19–22 can be readily accessed by means of a screwdriver or the like, the shaft of which is indicated at 143, by means of the aligned holes 103 and 105. FIG. 7 indicates that one set of through holes 103, 105 and 107 at an uppermost end of rail members 9 and 10 can be used to receive, in addition to a fastener 19, a retaining clip 146 positioned between holes 103 and 105 to limit any undesirable upward vertical movement of shutter panels 32 within channels 39. In addition, third wall 59 of enclosure 52 may be corrugated such as indicated at 148 to enhance the mounting thereof against building wall 67.

Figure 8:
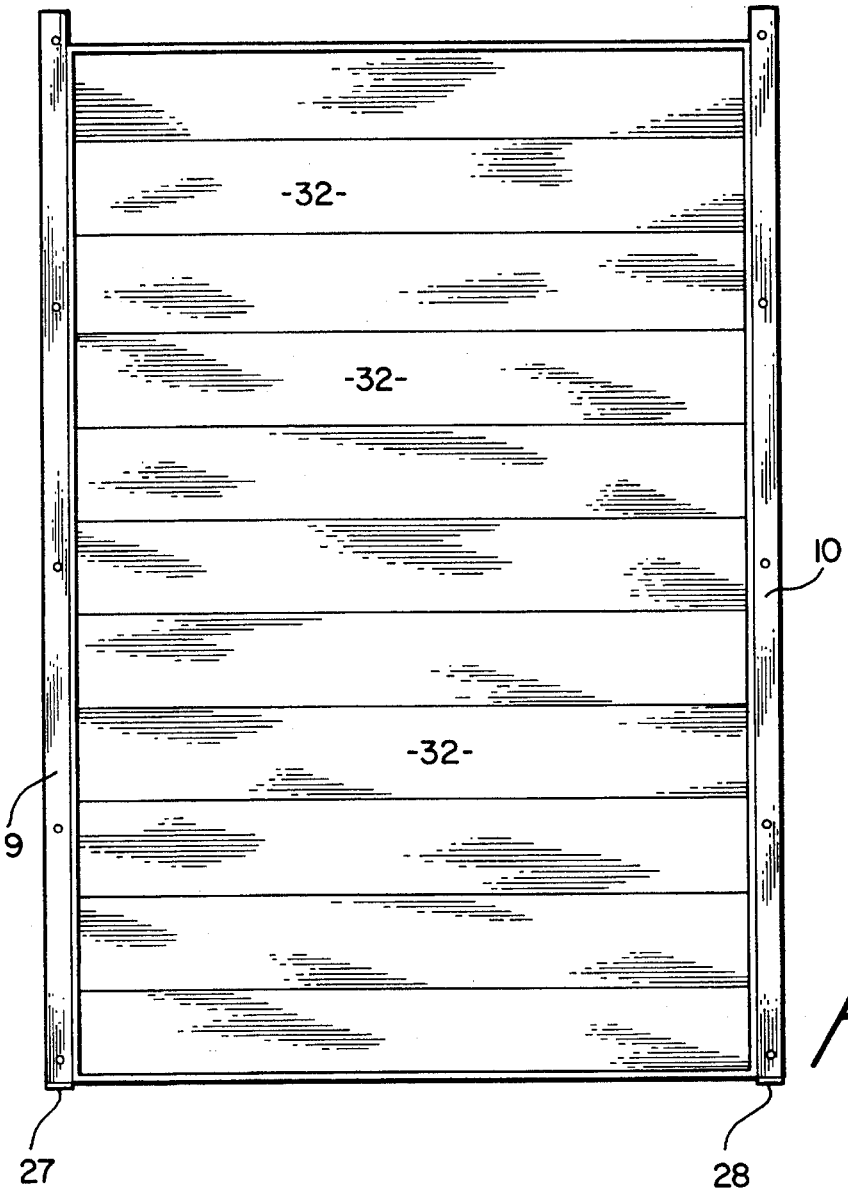
FIG. 8 is a front view of the shutter assembly of FIG. 1 shown in an assembled state.

FIG. 8 is a front view of shutter assembly 2 in an assembled state. As shown, L-shaped brackets 27 and 28 have been secured within slots 50 in the manner set forth above so as to close off the bottom ends of channels 39. Shutter panels 32 have been positioned within channels 39 and extend traversely between rail members 9 and 10. The particular number of shutter panels utilized will obviously vary depending upon the length of the rail members 9 and 10 and the size of the glass structure to be protected.

Figure 9:
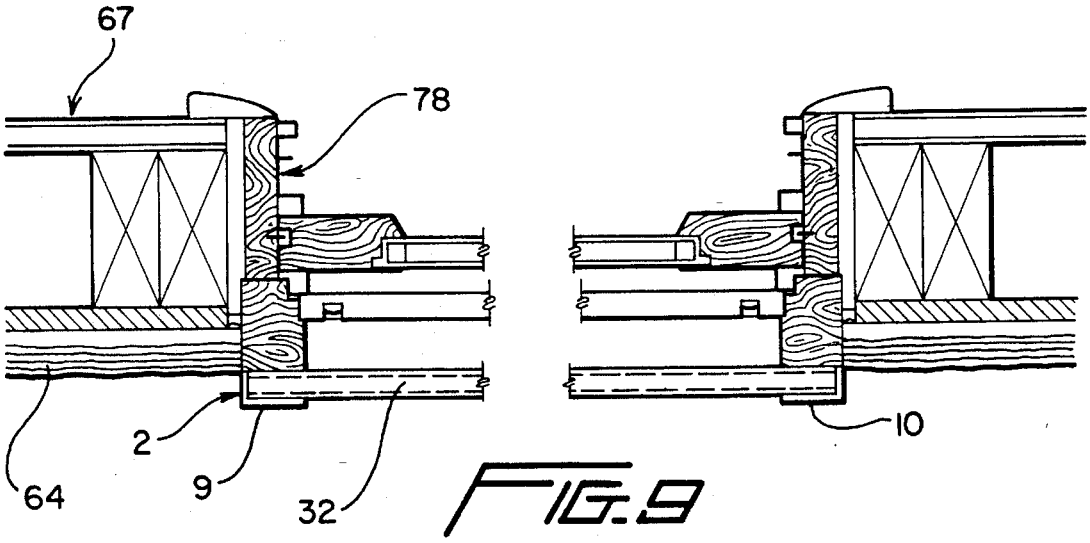
FIG. 9 is a cross-sectional top view of a portion of a building with a second shutter assembly embodiment mounted in connection with a window therein.

FIG. 9 depicts a second embodiment of the invention wherein shutter assembly 2 is formed as part of window frame 78. As clearly shown in this Figure, rail members 9 and 10 extend outwardly beyond exterior surface 64 of building wall 67 so as to readily enable shutter panels 32 to be inserted therein. In this embodiment, the lower ends of channels 39 can be closed off by a lower window pane, a planar plate extending thereacross or the like. In all other respects, the second embodiment depicted in this Figure is configured and functions in a manner substantially identical to that discussed above.

By the above discussion, it should be readily apparent that the rail members 9 and 10 of shutter assembly 2 only extend slightly beyond the outer surface 64 of the building wall 67 so as to maintain the overall aesthetic appearance of the building. Shutter assembly 2 is economical to manufacture, mainly since rail members 9 and 10 are extruded. In addition, forming shutter panels 32 in a honeycomb configuration reduces material costs without sacrificing strength. Actually, shutter panels 32, brackets 27, 28 and retaining clip 146 are preferably formed from an extrusion process as well to further reduce manufacturing costs. Once rail members 9 and 10 are secured against building wall 67, they will remain fixed. Upon receiving notice of an impending storm, shutter panels 32 can be taken from a remote storage location and placed within channels 39. Following the storm, shutter panels 32 can again be easily stored for future use.

Although described with respect to preferred embodiments of the invention, it should be readily understood that various changes and/or modifications can be made to the invention without departing from the spirit thereof. In general, the invention is only intended to be limited by the scope of the following claims.

We claim:

1. A shutter assembly for use in protecting windows and the like of a building during severe weather storms comprising:

a pair of elongated rail members, each of said rail members including a longitudinally extending channel that is substantially U-shaped in cross-section such that each channel defines a longitudinally extending opening on one side thereof along with opposing first and second longitudinally spaced open ends, and a slot extending longitudinally adjacent said channel, said channel of each of said rail members being defined by longitudinally extending first and second side walls that are spaced and interconnected by a longitudinally extending bridging wall, said longitudinally extending opening opposing said bridging wall, said slot extending within an enclosure defined by opposing pairs of substantially parallel arranged walls, one wall of said opposing pairs of walls being constituted by the second side wall of said channel;

means for mounting said rail members about a window or the like in a substantially parallel and spaced manner with the longitudinally extending opening of each channel facing one another;

means for closing off the first open end of each of said channels, said closing means including a first portion projecting into a respective one of said slots and a second portion extending across at least a portion of the first open end of each of said channels; and at least one shutter panel adapted to be inserted between said rail members within said channels, the degree of insertion of said at least one shutter panel being limited by said closing means.

2. A shutter assembly as claimed in claim 1, wherein said mounting means comprises a plurality of longitudinally spaced apertures and a plurality of fasteners, each of said apertures extending through a respective one of said rail members and being adapted to receive a respective one of said fasteners.

3. A shutter assembly as claimed in claim 2, wherein the first and second portions of said closing means combine to form a substantially L-shaped bracket.

4. A shutter assembly as claimed in claim 3, herein said L-shaped bracket is formed with a through hole that is adapted to be aligned with one of said plurality of apertures and to receive a respective one of said fasteners, said through hole being smaller in diameter than said one of said plurality of apertures.

5. A shutter assembly for protecting a window of a building during severe weather conditions comprising:

a window frame adapted to be mounted within an opening formed between inner and outer walls of a building;

a pair of elongated rail members formed from an extruded material, each of said rail members including a longitudinally extending channel that is substantially U-shaped in cross-section such that each channel defines a longitudinally extending opening on one side thereof along with opposing first and second longitudinally spaced open ends, said rail members being arranged in substantially parallel and spaced manner on opposing sides of said window frame with the longitudinally extending opening of each channel facing one another, said channels projecting beyond the outer wall of the building;

means for closing off the first open end of each of said channels, said closing means extending across the first open end of each of said channels; and at least one shutter panel adapted to be inserted between said rail members within said channels, the degree of insertion of said at least one shutter panel being limited by said closing means, said at least one shutter panel is internally honeycombed structured and is formed from an extruded material.

6. A shutter assembly for use in protecting windows and the like of a building during severe weather storms comprising:

a pair of elongated rail members, each of said rail members including a longitudinally extending channel that is substantially U-shaped in cross-section such that each channel defines a longitudinally extending opening on one side thereof along with opposing first and second longitudinally spaced open ends, and a slot extending longitudinally adjacent said channel;

means for mounting said rail members about a window or the like in a substantially parallel and spaced manner with the longitudinally extending opening of each channel facing one another; said mounting means comprises a plurality of longitudinally spaced apertures and a plurality of fasteners, each of said apertures extending through a respective one of said rail members and being adapted to receive a respective one of said fasteners;

means for closing off the first open end of each of said channels, said closing means including a first portion projecting into a respective one of said slots and a second portion extending across at least a portion of the first open end of each of said channels; and at least one shutter panel adapted to be inserted between said rail members within said channels, the degree of insertion of said at least one shutter panel being limited by said closing means.

7. A shutter assembly as claimed in claim 6, wherein the first and second portions of said closing means combine to form a substantially L-shaped bracket.

8. A shutter assembly for use in protecting windows and the like of a building during severe weather storms comprising;

a pair of elongated rail members, each of said rail members including a longitudinally extending channel that is substantially U-shaped in cross-section such that each channel defines a longitudinally extending opening on one side thereof along with opposing first and second longitudinally spaced open ends, and a slot extending longitudinally adjacent said channel;

means for mounting said rail members about a window or the like in a substantially parallel and spaced manner with the longitudinally extending opening of each channel facing one another;

means for closing off the first open end of each of said channels, said closing means including a first portion projecting into a respective one of said slots and a second portion extending across at least a portion of the first open end of each of said channels; and a plurality of shutter panels transversely extending between said rail members within said channels, each of said shutter panels including first and second longitudinally spaced, transversely extending and interengageing edges, said first edge defining a tongue and said second edge defining a groove, the degree of insertion of a first one of said shutter panels being limited by said closing means.

9. A shutter assembly as claimed in claim 8, wherein each of said shutter panels are internally honeycombed structured.

10. A shutter assembly as claimed in claim 8, further including a retainer clip adapted to close off the second open end of at least one of said channels.

11. A shutter assembly for protecting a window of a building during severe weather conditions comprising:

a window frame adapted to be mounted within an opening formed between inner and outer walls of a building;

a pair of elongated rail members, each of said rail members including a longitudinally extending channel that is substantially U-shaped in cross-section such that each channel defines a longitudinally extending opening on one side thereof along with opposing first and second longitudinally spaced open ends, said rail members being arranged in substantially parallel and spaced manner on opposing sides of said window frame with the longitudinally extending opening of each channel facing one another, said channels projecting beyond the outer wall of the building;

means for closing off the first open end of each of said channels, said closing means extending across the first open end of each of said channels;

at least one shutter panel adapted to be inserted between said rail members within said channels, the degree of insertion of said at least one shutter panel being limited by said closing means; and a retainer clip adapted to close off the second open end of at least one of said channels.

12. A shutter assembly for use in protecting windows and the like of a building during severe weather storms comprising;

a pair of elongated rail members formed from an extruded material, each of said rail members including a longitudinally extending channel that is substantially U-shaped in cross-section such that each channel defines a longitudinally extending opening on one side thereof along with opposing first and second longitudinally spaced open ends, and a slot extending longitudinally adjacent said channel;

means for mounting said rail members about a window or the like in a substantially parallel and spaced manner with the longitudinally extending opening of each channel facing one another;

means for closing off the first open end of each of said channels, said closing means including a first portion projecting into a respective one of said slots and a second portion extending across at least a portion of the first open end of each of said channels; and at least one shutter panel adapted to be inserted between said rail members within said channels, the degree of insertion of said at least one shutter panel being limited by said closing means, said at least one shutter panel is internally honeycombed structured and is formed from an extruded material.

13. A shutter assembly as claimed in claim 12, further including a retainer clip adapted to close off the second open end of at least one of said channels, said retainer clip and said closing means being formed from an extruded material.

14. A shutter assembly for protecting a window of a building during severe weather conditions comprising:

a window frame adapted to be mounted within an opening formed between inner and outer walls of a building;

a pair of elongated rail members, each of said rail members including a longitudinally extending channel that is substantially U-shaped in cross-section such that each channel defines a longitudinally extending opening on one side thereof along with opposing first and second longitudinally spaced open ends, said rail members being arranged in a substantially parallel and spaced manner on opposing sides of said window frame with the longitudinally extending opening of each channel facing one another, said channels projecting beyond the outer wall of the building, said channel of each of said rail members is defined by longitudinally extending first and second side walls that are spaced and interconnected by a longitudinally extending bridging wall, said longitudinally extending opening opposing said bridging wall;

means for closing off the first open end of each of said channels, said closing means extending across the first open end of each of said channels; and a plurality of shutter panels transversely extending between said rail members within said channels, each of said shutter panels including first and second longitudinally spaced, transversely extending and interengaging edges, said first edge defining a tongue and said second edge defining a groove, the degree of insertion of a first one of said shutter panels being limited by said closing means.

15. A shutter assembly as claimed in claim 14, wherein each of said shutter panels are internally honeycombed structured.

* * * * *